US010473279B2

(12) United States Patent
Chien et al.

(10) Patent No.: US 10,473,279 B2
(45) Date of Patent: Nov. 12, 2019

(54) WIDE-ANGLE LINEAR LED LIGHTING DEVICE

(71) Applicant: DELTA ELECTRONICS, INC., Taoyuan (TW)

(72) Inventors: Wei-Ting Chien, Taoyuan (TW); Chia-Wen Hsu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 95 days.

(21) Appl. No.: 15/415,154

(22) Filed: Jan. 25, 2017

(65) Prior Publication Data

US 2018/0209598 A1 Jul. 26, 2018

(51) Int. Cl.

| | |
|---|---|
| ***F21S 4/28*** | (2016.01) |
| ***F21V 3/02*** | (2006.01) |
| *F21V 17/10* | (2006.01) |
| *F21Y 115/10* | (2016.01) |
| *F21Y 103/10* | (2016.01) |
| *F21Y 107/30* | (2016.01) |

(52) U.S. Cl.

CPC ..... *F21S 4/28* (2016.01); *F21V 3/02* (2013.01); *F21V 17/101* (2013.01); *F21Y 2103/10* (2016.08); *F21Y 2107/30* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 3,924,799 | A * | 12/1975 | Lorenz | B65D 5/02 206/418 |
| 7,559,672 | B1 * | 7/2009 | Parkyn | A47B 97/00 362/127 |
| D634,470 | S * | 3/2011 | Hsieh | D26/118 |
| 7,989,827 | B2 * | 8/2011 | Hsu | H01L 25/0753 257/100 |
| 8,919,991 | B2 * | 12/2014 | Lee | F21V 29/004 362/218 |
| 9,644,828 | B1 * | 5/2017 | May | F21V 7/00 |
| 9,739,427 | B1 * | 8/2017 | May | F21V 7/00 |
| 9,927,073 | B2 * | 3/2018 | May | F21K 9/278 |

(Continued)

FOREIGN PATENT DOCUMENTS

| | | | |
|---|---|---|---|
| WO | 2008097496 | A1 | 8/2008 |
| WO | 2014182325 | A1 | 11/2014 |

*Primary Examiner* — Elmito Breval

(74) *Attorney, Agent, or Firm* — Kirton McConkie; Evan R. Witt

(57) ABSTRACT

A wide-angle linear LED lighting device includes a polygonal lampshade, a base and at least two LED modules. The polygonal lampshade includes at least two lateral parts and an installation part. The base is disposed within the polygonal lampshade and disposed on an inner surface of the installation part. There is an included angle between the base and the inner surface of the installation part. The at least two LED modules are disposed on the base. The light beams emitted by the at least two LED modules are outputted from different lateral parts of the polygonal lampshade. The light-outputting characteristics of the wide-angle linear LED lighting device are correlated with the included angle and the at least two LED modules.

13 Claims, 10 Drawing Sheets

(56) References Cited

U.S. PATENT DOCUMENTS

| | | | | |
|---|---|---|---|---|
| 2008/0062689 | A1* | 3/2008 | Villard | F21V 14/02 362/249.07 |
| 2010/0085746 | A1 | 4/2010 | Zheng | |
| 2011/0019421 | A1* | 1/2011 | Lai | F21K 9/27 362/249.06 |
| 2011/0267805 | A1* | 11/2011 | Hua | F21S 6/005 362/101 |
| 2012/0033420 | A1* | 2/2012 | Kim | F21K 9/00 362/235 |
| 2012/0140441 | A1 | 6/2012 | Chang | |
| 2013/0093963 | A1* | 4/2013 | Kasai | G02F 1/133603 348/739 |
| 2016/0000046 | A1* | 1/2016 | Li | A01K 31/002 362/1 |

* cited by examiner

WIDE-ANGLE LINEAR LED LIGHTING DEVICE

FIELD OF THE INVENTION

The present invention relates to a lighting device, and more particularly to a wide-angle linear LED lighting device.

BACKGROUND OF THE INVENTION

As known, light emitting diodes (LEDs) have many benefits such as high luminance, lower power consumption and long service life. Consequently, light emitting diodes have been widely used in general instruments, indicating lamps or lighting devices. In case that light emitting diodes are applied to a lighting device, the lighting device usually comprises a lighting module. The lighting module comprises plural light emitting diodes that are connected with each other in series or in parallel. Consequently, the light beams emitted by the lighting device have large coverage range and high brightness.

FIG. 1A is a schematic perspective view illustrating a portion of a conventional linear LED lighting device. As shown in FIG. 1A, the conventional linear LED lighting device 1 comprises a lampshade 10 and a LED module 11 (see FIG. 1B). The LED module 11 is covered by the lampshade 10. The lampshade 10 is made of a transparent material. Moreover, plural textured structures (not shown) are formed on a surface of the lampshade 10, and a diffuser (not shown) is disposed within the lampshade 10. Due to the textured structures and the diffuser, a desired light pattern is produced.

As shown in FIG. 1A, the lampshade 10 has a linear tube profile with a hollow square cross section. Please refer to FIG. 1B. FIG. 1B schematically illustrates some simulated light patterns generated by the conventional linear LED lighting device of FIG. 1A. As shown in FIG. 1B, the LED module 11 is disposed within the lampshade 10. The LED module 11 comprises plural light emitting diodes (not shown), and the plural light emitting diodes are arranged in a line. Moreover, the linear LED lighting device is equipped with optical elements (e.g., lenses) as a diffuser. By the LED module 11, the diffuser and the lampshade 10, the desired light pattern is produced.

In FIG. 1B, three light patterns (a), (b) and (c) are shown. These light patterns (a), (b) and (c) are produced by three linear LED lighting devices 1, 1' and 1", respectively. The linear LED lighting device 1 comprises a lampshade 10 or a corresponding diffuser. The linear LED lighting device 1' comprises a lampshade 10' or a corresponding diffuser. The linear LED lighting device 1" comprises a lampshade 10" or a corresponding diffuser. The lampshades 10, 10' and 10" have different textured structures or different type of diffusers. In the light pattern (a), the light intensity on periphery region is stronger and the light intensity on the middle region is weaker. In the light pattern (b), the light intensity is centralized to the middle region. In the light pattern (c), the light intensity in the coverage region of the light beams is uniform. In the light pattern (a), (b) or (c), the coverage range of the light beams is mainly located under the linear LED lighting device. Due to the angular limitations, the luminous efficiency is usually unsatisfied. Moreover, since the lampshade has special textured structures or an additional diffuser is needed, the fabricating cost of the conventional linear LED lighting device is high.

FIG. 2A is a schematic perspective view illustrating the outer appearance of another conventional linear LED lighting device. As shown in FIG. 2A, the conventional linear LED lighting device 2 comprises a lampshade 20 and a LED module 21. The LED module 21 is arranged in a line. The lampshade 20 has a linear tube profile with a hollow circular cross section. The lampshade 20 is made of a translucent material. Consequently, the lampshade 20 is a hazy lampshade. Since the hazy lampshade has the curvy surface, the light beams from the LED module 21 are scattered more uniformly. Under this circumstance, it is not necessary to use an additional diffuser. In comparison with the linear LED lighting device 1 of FIG. 1A, the fabricating cost of the linear LED lighting device 2 is lower. FIG. 2B is a diagram showing a simulated light intensity distribution generated by the conventional linear LED lighting device of FIG. 2A. As shown in FIG. 2B, the linear LED lighting device 2 produces a circular light pattern. The circular light pattern is advantageous because of the optical uniformity. However, the linear LED lighting device 2 cannot emit the light beams in a wide-angle illumination manner or at a specified illumination angle. That is, the applications are limited.

Therefore, there is a need of providing a wide-angle linear LED lighting device in order to solve the above drawbacks.

SUMMARY OF THE INVENTION

An object of the present invention provides a wide-angle linear LED lighting device. The wide-angle linear LED lighting device comprises a polygonal lampshade, at least two LED modules and a base. The profile of the polygonal lampshade, the included angle between the base and an installation part of the polygonal lampshade and the height of the raised part are designed and matched, so that the beam angle is widened and the light beams are scattered at a wide angle. Moreover, the backside energy is increased, the spatial background brightness is increased, and the anti-glare function is achieved. Namely, the wide-angle linear LED lighting device having better light-outputting characteristics can be achieved.

In accordance with an aspect of the present invention, there is provided a wide-angle linear LED lighting device. The wide-angle linear LED lighting device includes a polygonal lampshade, a base and at least two LED modules. The polygonal lampshade includes at least two lateral parts and an installation part. The base is disposed within the polygonal lampshade and disposed on an inner surface of the installation part. There is an included angle between the base and the inner surface of the installation part. The at least two LED modules are disposed on the base. The light beams emitted by the at least two LED modules are outputted from different lateral parts of the polygonal lampshade. The light-outputting characteristics of the wide-angle linear LED lighting device are correlated with the included angle and the at least two LED modules.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
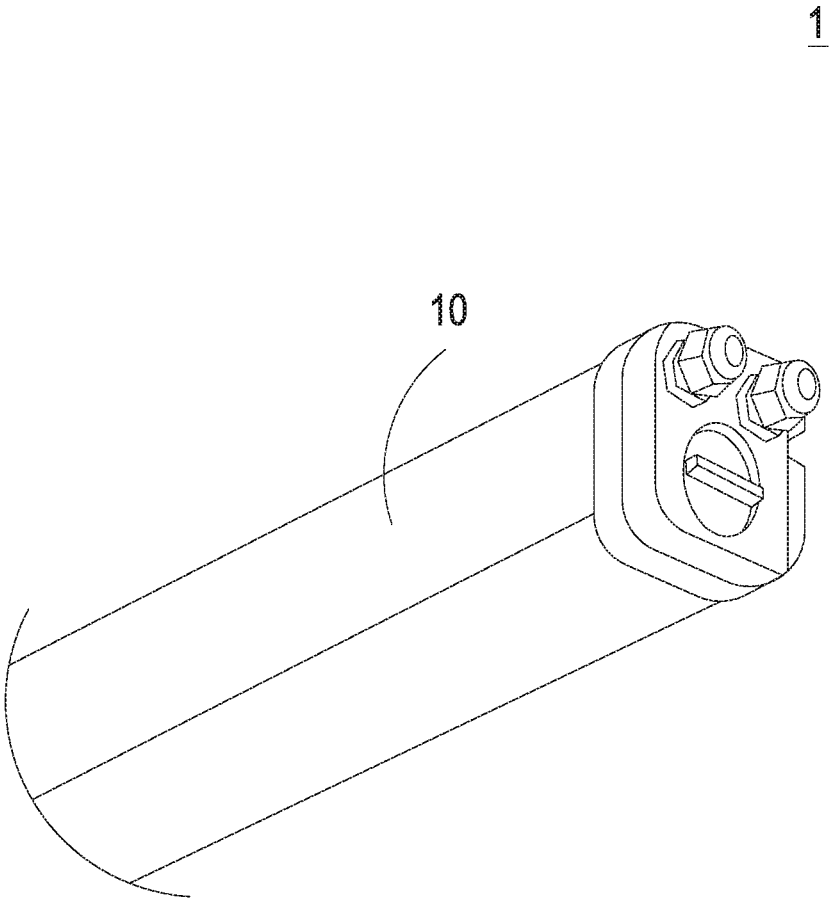
FIG. 1A PRIOR ART
FIG. 1A is a schematic perspective view illustrating a portion of a conventional linear LED lighting device.
Figure 1B:
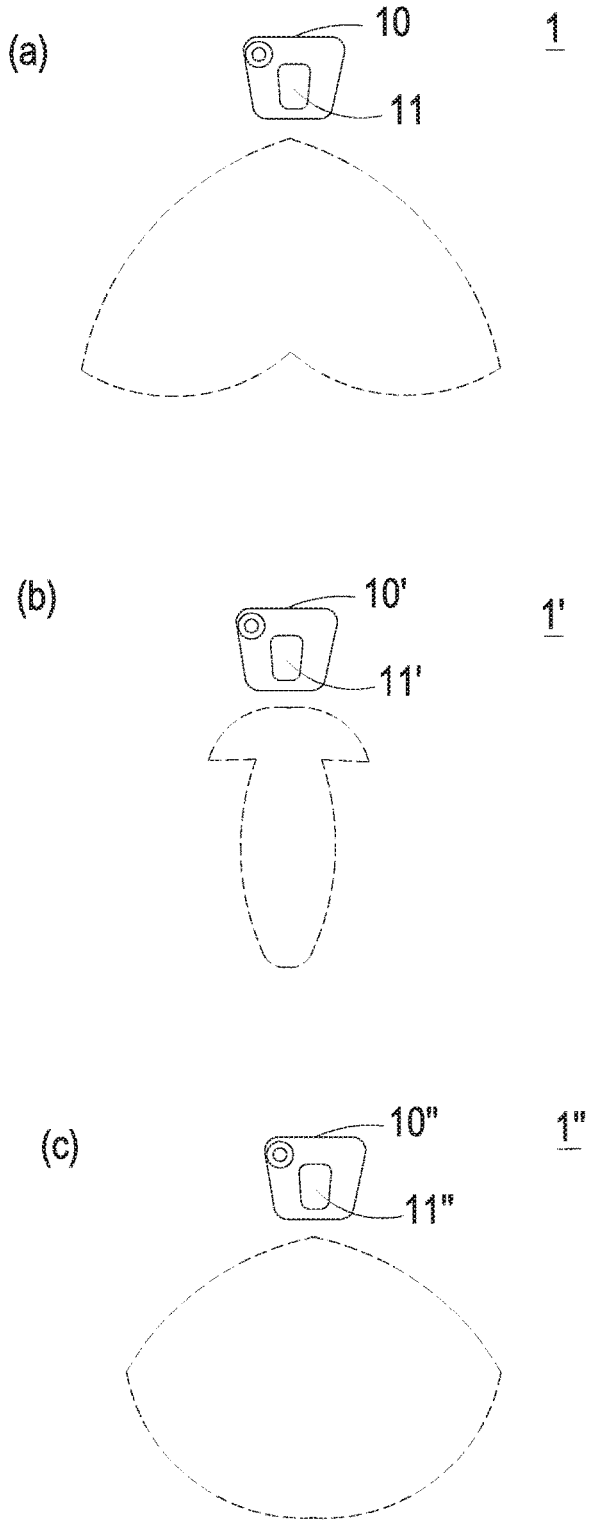
FIG. 1B PRIOR ART
FIG. 1B schematically illustrates some simulated light patterns generated by the conventional linear LED lighting device of FIG. 1A.
Figure 2A:
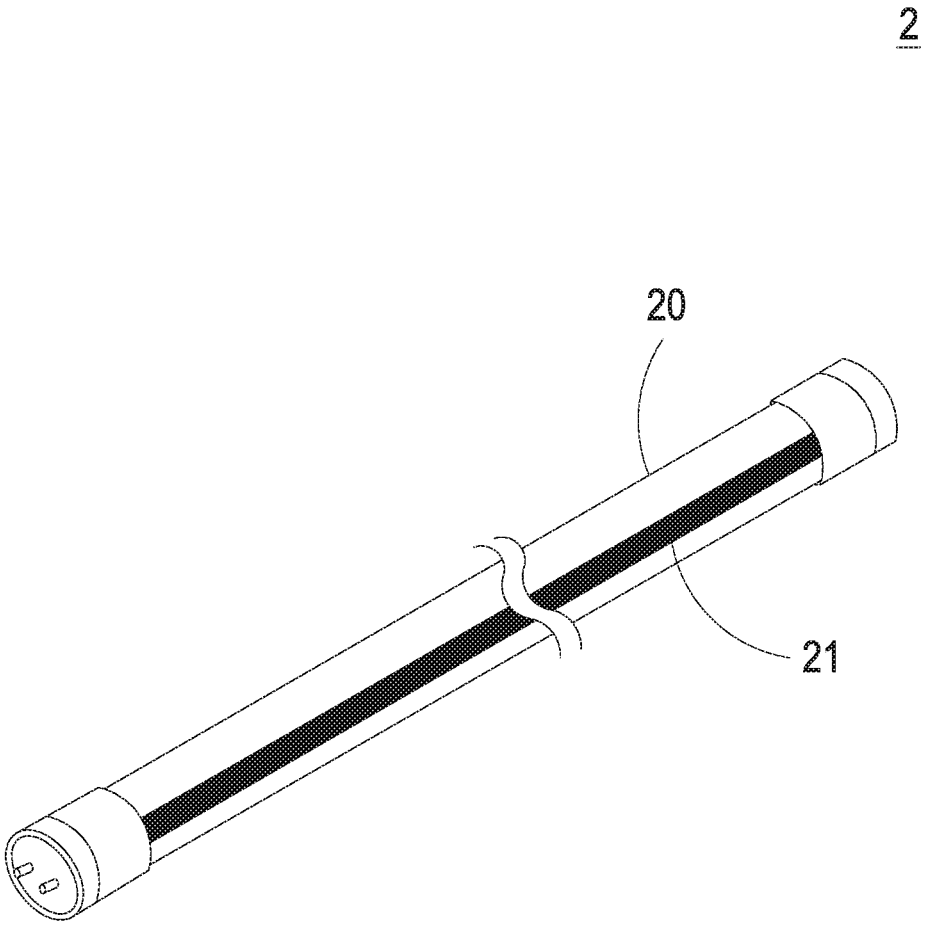
FIG. 2A PRIOR ART
FIG. 2A is a schematic perspective view illustrating the outer appearance of another conventional linear LED lighting device.
Figure 2B:
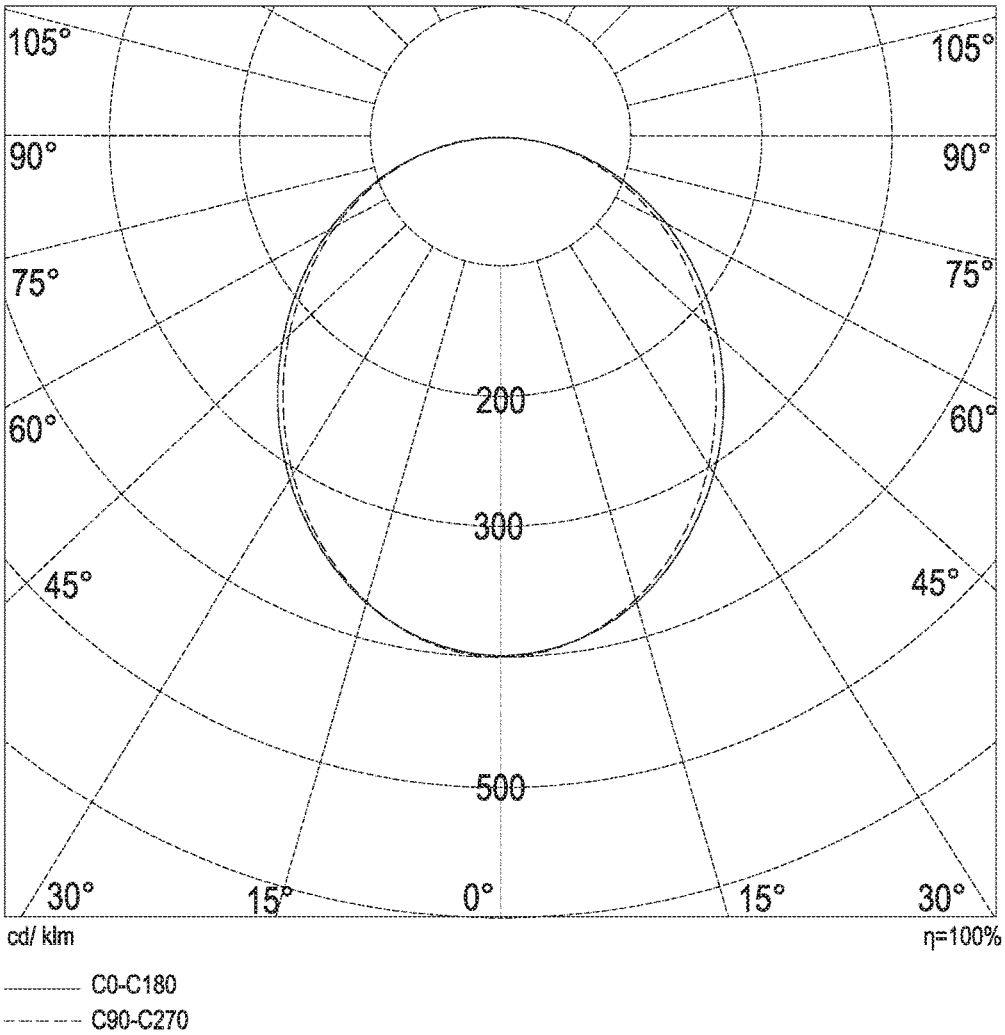
FIG. 2B PRIOR ART
FIG. 2B is a diagram showing a simulated light intensity distribution generated by the conventional linear LED lighting device of FIG. 2A.
Figure 3:
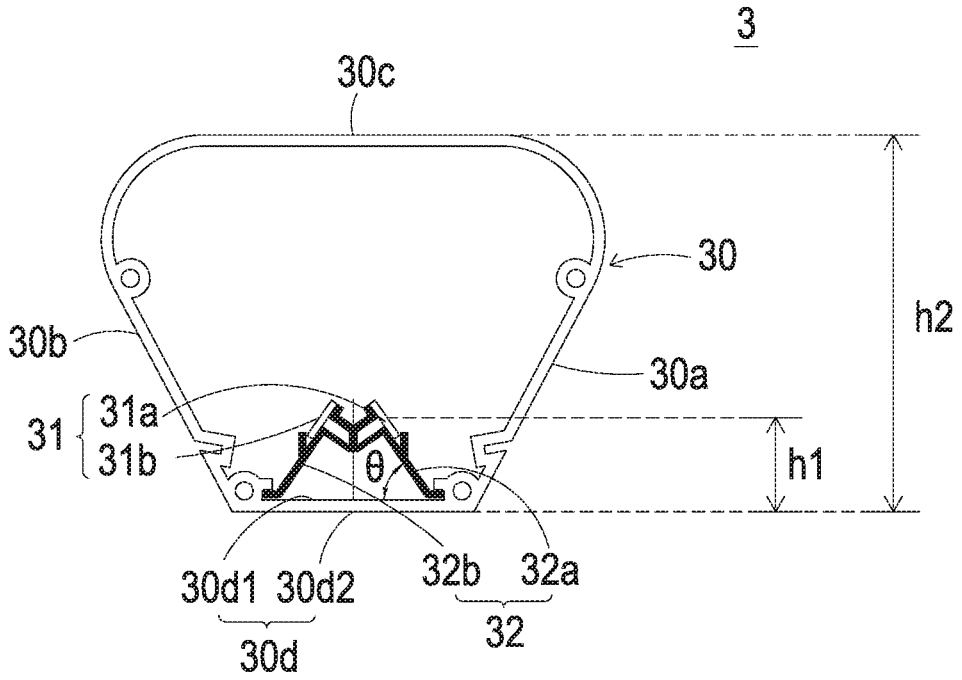
FIG. 3 is a schematic cross-sectional view illustrating a wide-angle linear LED lighting device according to a first embodiment of the present invention.

FIG. 3 is a schematic cross-sectional view illustrating a wide-angle linear LED lighting device according to a first embodiment of the present invention. As shown in FIG. 3, the wide-angle linear LED lighting device 3 comprises a polygonal lampshade 30, at least two LED modules 31 and a base 32. The polygonal lampshade 30 comprises at least two lateral parts 30*a* and 30*b* and an installation part 30*d*. The base 32 is disposed within the polygonal lampshade 30. The base 32 is disposed on an inner surface 30*d*1 of the installation part 30*d*. The at least two LED modules 31 are disposed on the base 32. The light beams emitted by the at least two LED modules 31 are outputted from different lateral parts. Moreover, there is an included angle θ between the base 32 and the inner surface 30*d*1 of the installation part 30*d*. The light-outputting characteristics are correlated with the included angle θ and the at least two LED modules 31. According to the included angle θ and the profile of the polygonal lampshade 30, the at least two LED modules 31 emit light beams at a wide angle. After the light beams pass through the polygonal lampshade 30, the light beams are scattered more uniformly. Consequently, the backside energy is increased, and the spatial background brightness is enhanced.

In this embodiment, the wide-angle linear LED lighting device 3 further comprises some other components such as a circuit board, a heat sink, a driver and a coupling structure. These components are well known to those skilled in the art. The positions of these components and the ways of installing these components may be varied according to the practical requirements.

In this embodiment, the polygonal lampshade 30 of the wide-angle linear LED lighting device 3 has a linear hollow tube profile with a hollow trapezoid cross section. In this embodiment, the cross section of the polygonal lampshade 30 is defined by four parts, including a first lateral part 30*a*, a second lateral part 30*b*, a front part 30*c* and the installation part 30*d*. The front part 30*c* and the installation part 30*d* are opposed to each other. The first lateral part 30*a* and the second lateral part 30*b* are opposed to each other. It is noted that the profile of the polygonal lampshade 30 is not restricted. For example, the polygonal lampshade 30 has a hollow triangular cross section, a hollow quadrilateral cross section, a hollow pentagonal cross section or a hollow hexagonal cross section. Moreover, the hollow quadrilateral cross section of the polygonal lampshade 30 is a hollow square cross section, a hollow rectangular cross section or a hollow trapezoid cross section. It is noted that numerous modifications and alterations may be made while retaining the teachings of the invention.

In this embodiment, the front part 30*c* is longer than the installation part 30*d*. Preferably but not exclusively, the polygonal lampshade 30 is an integral structure, and the polygonal lampshade 30 is made of a translucent plastic material. The installation part 30*d* has the inner surface 30*d*1 and an outer surface 30*d*2. The inner surface 30*d*1 is disposed within the polygonal lampshade 30. The base 32 is disposed on the inner surface 30*d*1 of the installation part 30*d*. The outer surface 30*d*2 of the installation part 30*d* faces a ceiling (not shown) or any other appropriate mounting surface.

Please refer to FIG. 3 again. The base 32 is disposed within the polygonal lampshade 30 and installed on the inner surface 30*d*1 of the installation part 30*d*. In this embodiment, the base 32 comprises at least two slabs (e.g., a first slab 32*a* and a second slab 32*b*). Preferably but not exclusively, the at least two slabs of the base 32 are integrally formed into one piece, and the base 32 is an aluminum extrusion base. The at least two LED modules 31 includes a first LED module 31*a* and a second LED module 31*b*. The first LED module 31*a* and the second LED module 31*b* are respectively disposed on the first slab 32*a* and the second slab 32*b* of the base 32. By adjusting the installations and the heights of the first slab 32*a* and the second slab 32*b* of the base 32, the installations and the heights of the first LED module 31*a* and the second LED module 31*b* are correspondingly adjusted. According to the adjusted installations and heights of the first LED module 31*a* and the second LED module 31*b* and the profile of the polygonal lampshade 30, the wide-angle linear LED lighting device 3 produces a desired wide-angle light pattern. As shown in FIG. 3, the included angle θ is formed between the first slab 32*a* of the base 32 and the inner surface 30*d*1 of the installation part 30*d*, and the included angle θ is formed between the second slab 32*b* of the base 32 and the inner surface 30*d*1 of the installation part 30*d*. Preferably, the included angle θ is in the range between 0 and 90 degrees, and preferably in the range between 0 and 60 degrees or in the range between 60 and 90 degrees. For example, in case that the included angle θ is 0 degree, the first slab 32*a* and the second slab 32*b* of the base 32 are in close contact with the inner surface 30*d*1 of the installation part 30*d*.

Figure 4A:
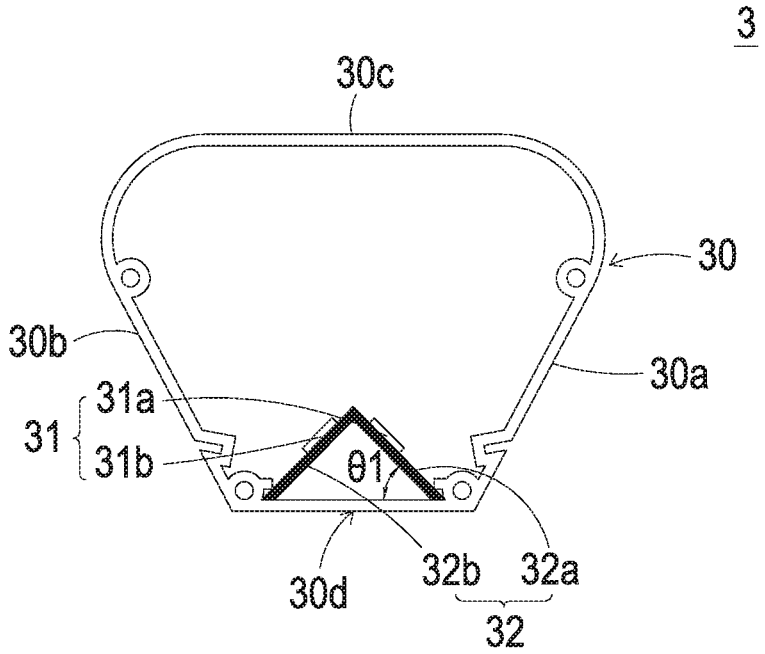
FIGS. 4A, 4B and 4C are schematic cross-sectional views illustrating three variant examples of the wide-angle linear LED lighting device of FIG. 3.
Figure 4B:
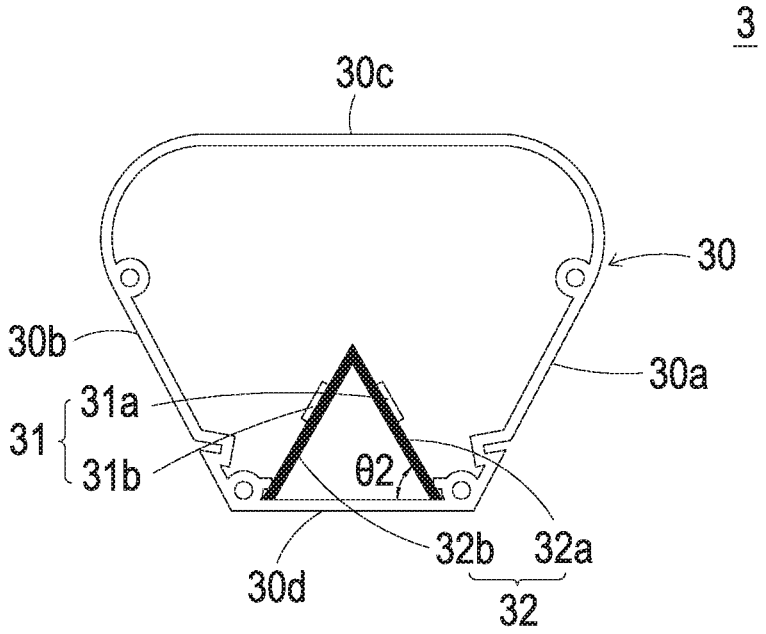
Figure 4C:
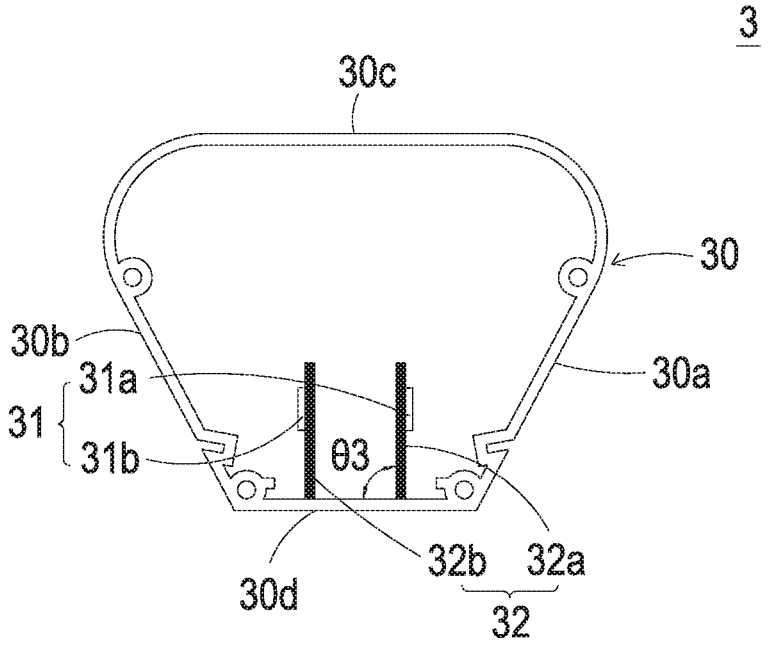

FIGS. 4A, 4B and 4C are schematic cross-sectional views illustrating three variant examples of the wide-angle linear LED lighting device of FIG. 3. As shown in FIG. 4A, the included angle θ1 between the first slab 32*a* (or the second slab 32*b*) of the base 32 and the inner surface 30*d*1 of the installation part 30*d* is 60 degrees. As shown in FIG. 4B, the included angle θ2 between the first slab 32*a* (or the second slab 32*b*) of the base 32 and the inner surface 30*d*1 of the installation part 30*d* is 75 degrees. As shown in FIG. 4C, the included angle θ3 between the first slab 32*a* (or the second slab 32*b*) of the base 32 and the inner surface 30*d*1 of the installation part 30*d* is 90 degrees. In the example of FIG. 4C, the first slab 32*a* and the second slab 32*b* of the base 32 are in parallel with each other. As the included angle θ is adjusted, the positions and orientations of the first LED module 31*a* and the second LED module 31*b* on the first slab 32*a* and the second slab 32*b* of the base 32 are adjusted according to the practical requirements.

Please refer to FIG. 3. There is a distance h1 between the first LED module 31*a* (or the second LED module 31*b*) and the inner surface 30*d*1 of the installation part 30*d*. Preferably but not exclusively, the distance h1 is in the range between 0 and 30 mm. Moreover, a distance h2 between the front part 30*c* and the installation part 30*d* of the polygonal lampshade 30 is a height of the wide-angle linear LED lighting device 3. Since the ratio h1/h2 and the profile of the polygonal lampshade 30 can be designed according to the practical design, the light beams passing through the polygonal lampshade 30 results in a wide-angle light pattern with enhanced backside energy. In some embodiments, the distance between the first slab 32*a* and the second slab 32*b* of the base 32 is in the range between 0 and 20 mm. Preferably but not exclusively, the distance between the first LED module 31*a* and the second LED module 31*b* is in the range between 0 and 20 mm. The orientations, heights and relative distances of the base 32 and the LED modules 31 may be varied according to the practical requirements.

The way of fixing the LED modules 31 on the base 32 is not restricted. As shown in FIG. 3, the first LED module 31*a* and the second LED module 31*b* are fixed on the first slab 32*a* and the second slab 32*b* of the base 32 through an engaging means. As shown in FIG. 4A, the first LED module 31*a* and the second LED module 31*b* are fixed on the first slab 32*a* and the second slab 32*b* of the base 32 through an adhesive (not shown).

Figure 5:
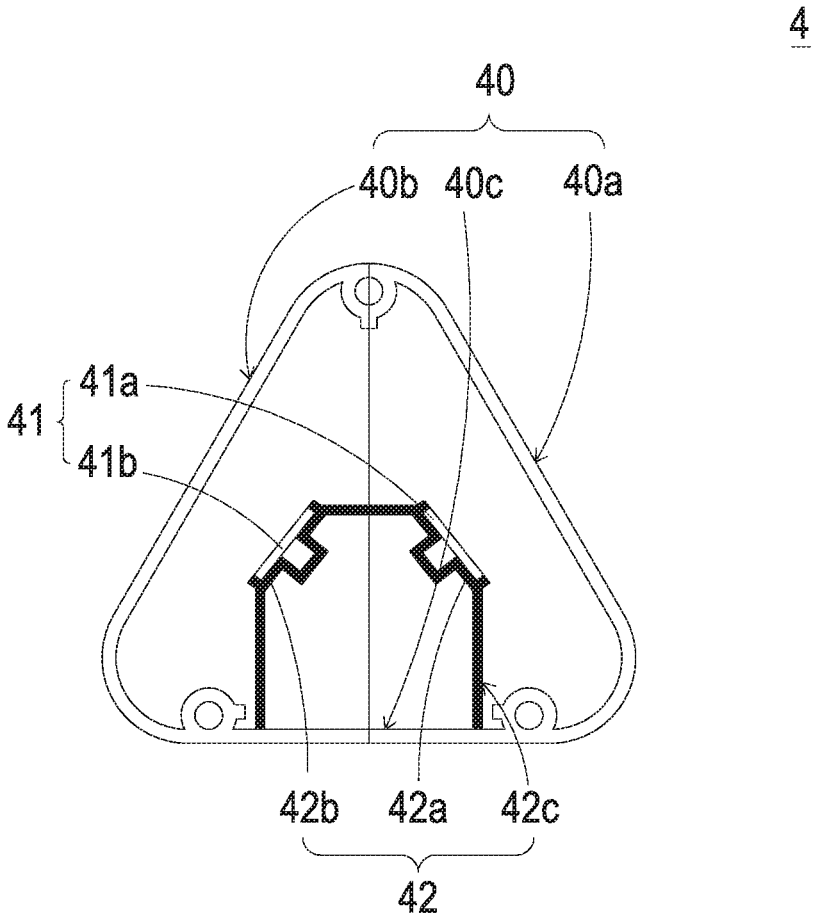
FIG. 5 is a schematic cross-sectional view illustrating a wide-angle linear LED lighting device according to a second embodiment of the present invention.

FIG. 5 is a schematic cross-sectional view illustrating a wide-angle linear LED lighting device according to a second embodiment of the present invention. As shown in FIG. 5, the wide-angle linear LED lighting device 4 comprises a polygonal lampshade 40, at least two LED modules 41 and a base 42. In this embodiment, the polygonal lampshade 40 of the wide-angle linear LED lighting device 4 has a linear hollow tube profile with a hollow triangular cross section. In this embodiment, the cross section of the polygonal lampshade 40 is defined by three parts, including a first lateral part 40*a*, a second lateral part 40*b* and an installation part 40*c*. The base 42 is disposed on the installation part 40*c*. The at least two LED modules 41 are disposed on the base 42. In this embodiment, the at least two LED modules 41 comprise a first LED module 41*a* and a second LED module 41*b*. The light beams emitted by the first LED module 41*a* are outputted from the first lateral part 40*a*. The light beams emitted by the second LED module 41*b* are outputted from the second lateral part 40*b*. The base 42 comprises a first slab 42*a*, a second slab 42*b* and a raised part 42*c*. Preferably but not exclusively, the first slab 42*a*, the second slab 42*b* and the raised part 42*c* of the base 42 are integrally formed into one piece, and the base 42 is an aluminum extrusion base. In an embodiment, the raised part 42*c* comprises two additional slabs. Alternatively, in another embodiment, the raised part 42*c* is a heat sink (not shown). The example of the raised part 42*c* may be varied according to the practical requirements. Due to the raised part 42*c*, the altitudes of the first slab 42*a* and the second slab 42*b* are increased. Consequently, the distance between the LED module 41*a* (or the LED module 41*b*) and the installation part 40*c* is increased. As mentioned above, the polygonal lampshade 40 has the hollow triangular cross section. After the light beams emitted by the LED modules 41 pass through the first lateral part 40*a* and the second lateral part 40*b* of the polygonal lampshade 40, a wide-angle light pattern with increased backside energy is produced.

Figure 6A:
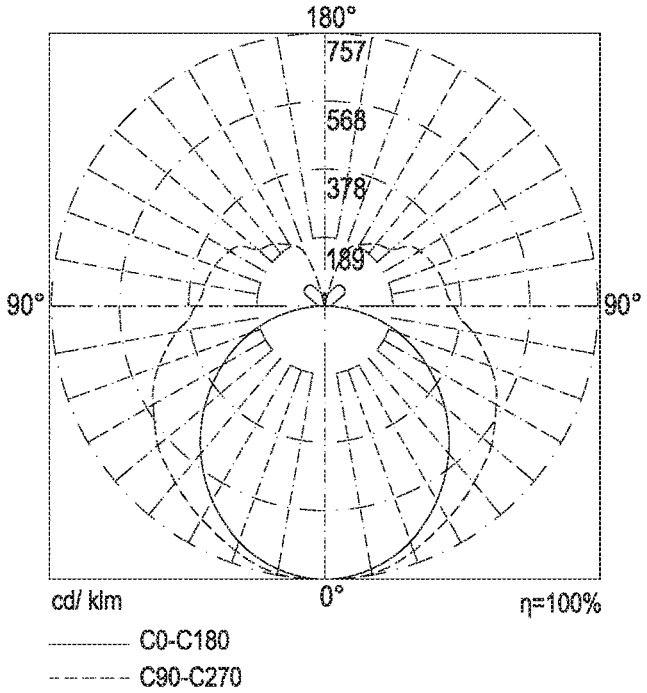
FIGS. 6A to 6F are diagrams showing some simulated light intensity distributions generated by the wide-angle linear LED lighting devices of FIG. 3 and FIG. 5.
Figure 6B:
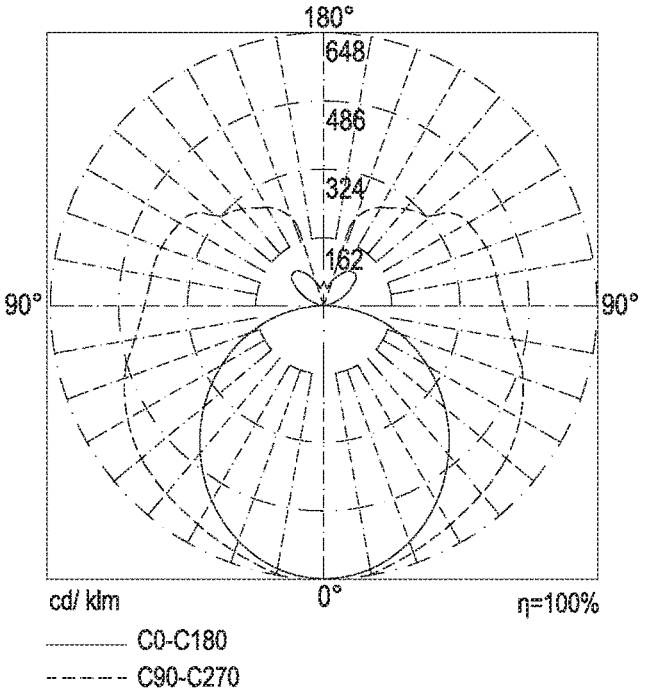
Figure 6C:
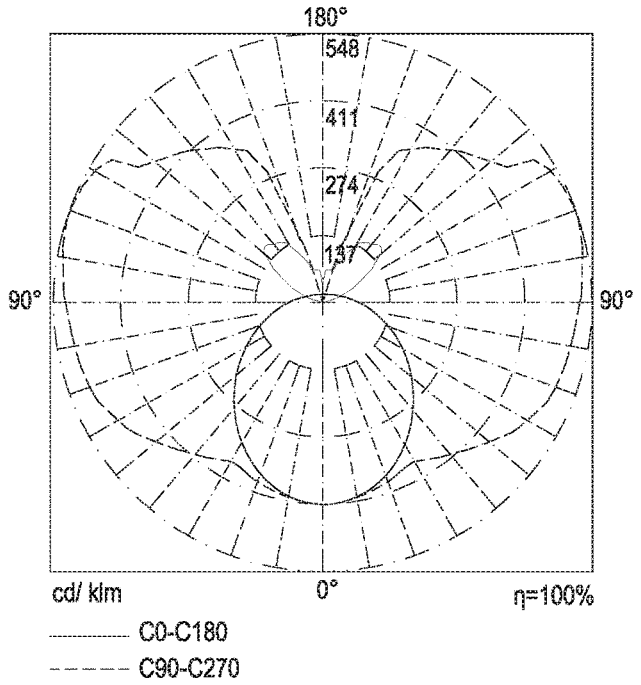

FIGS. 6A to 6F are diagrams showing some simulated light intensity distributions generated by the wide-angle linear LED lighting devices of FIG. 3 and FIG. 5. The light patterns of FIGS. 6A, 6B and 6C are generated by the wide-angle linear LED lighting device of FIG. 3. For producing the light pattern of FIG. 6A, the polygonal lampshade 30 has a hollow trapezoid cross section, the included angle θ is 60 degree, and the h1/h2 ratio is 26.5%. For producing the light pattern of FIG. 6B, the polygonal lampshade 30 has a hollow trapezoid cross section, the included angle θ is 75 degree, and the h1/h2 ratio is 26.5%. For producing the light pattern of FIG. 6C, the polygonal lampshade 30 has a hollow trapezoid cross section, the included angle θ is 90 degree, and the h1/h2 ratio is 26.5%. Moreover, the wide-angle linear LED lighting device is further equipped with a raised part. The operating parameters of the wide-angle linear LED lighting device and the measured data of the light pattern are listed in following Table 1. For producing the light patterns of FIGS. 6A, 6B and 6C, the polygonal lampshade 30 has the hollow trapezoid cross section and the height of the raised part is 13 mm. The backside energy (%) of the light pattern of FIG. 6A is 26.3%, the backside energy (%) of the light pattern of FIG. 6B is 32.10%, and the backside energy (%) of the light pattern of FIG. 6C is 46.10%. The beam angle of the light pattern of FIG. 6A is 175 degrees, the beam angle of the light pattern of FIG. 6B is 260 degrees, and the beam angle of the light pattern of FIG. 6C is 323 degrees. When compared with the conventional technology, the beam angle and the backside energy of the light patterns produced by the wide-angle linear LED lighting device are increased. Consequently, the spatial background brightness is increased, and the anti-glare function is achieved.

TABLE 1

Figure 6D:
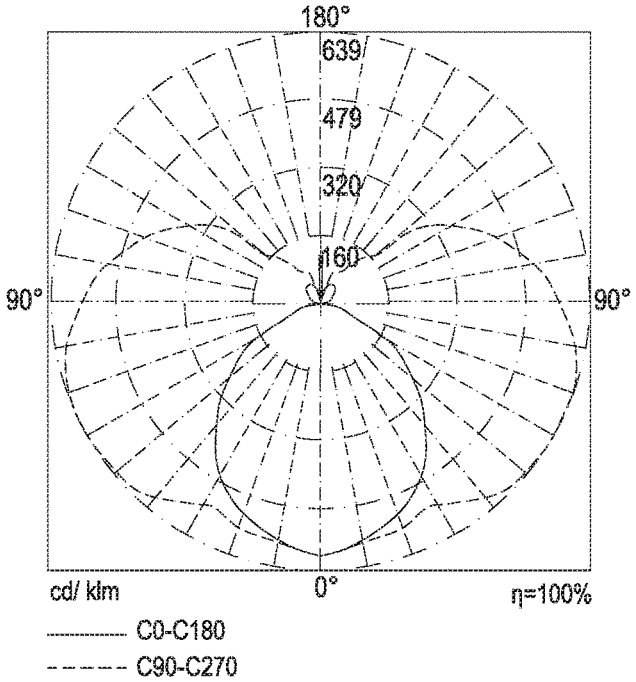
Figure 6E:
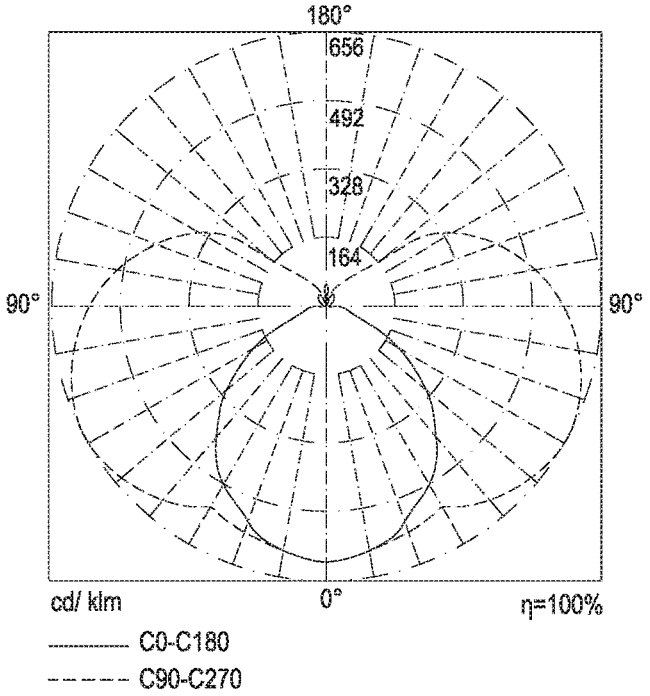
Figure 6F:
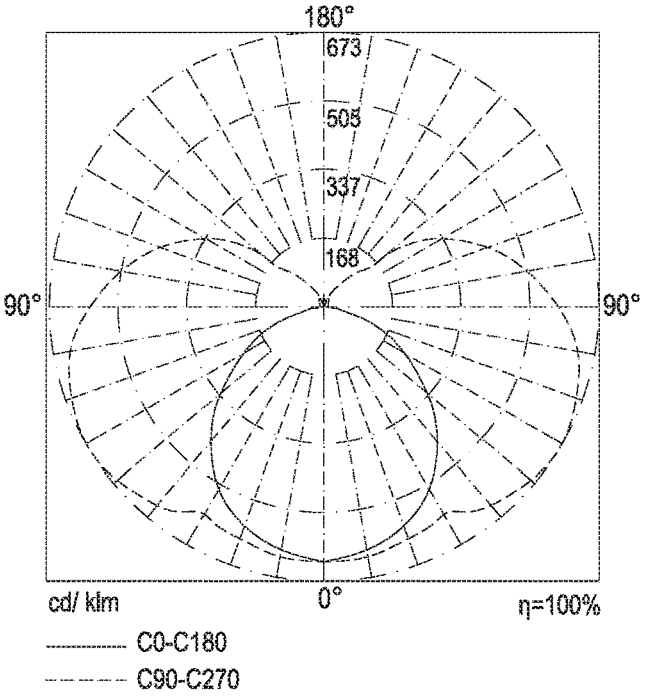

| | Light pattern | | | | | |
|---|---|---|---|---|---|---|
| | FIG. 6A | FIG. 6B | FIG. 6C | FIG. 6D | FIG. 6E | FIG. 6F |
| Lampshade | trapezoid | trapezoid | trapezoid | triangle | triangle | triangle |
| Angle θ | 60° | 75° | 90° | 60° | 60° | 60° |
| Raised part | 13 mm | 13 mm | 13 mm | 0 mm | 6 mm | 13 mm |
| Relative position | 26.5% | 26.5% | 26.5% | 0% | 13.6% | 29.5% |
| Backside energy (%) | 26.3% | 32.10% | 46.10% | 29.6% | 27.3% | 25.5% |
| Beam angle | 175 | 260 | 323 | 255 | 250 | 245 |
| Angle (max. light intensity) | 0 | 0 | 107.5 | 60 | 60 | 60 |
| ½ beam angle | 87 | 130 | 161 | 127 | 125 | 122 |
| Light intensity (directly below) | 204 cd/klm | 175 cd/klm | 109 cd/klm | 162 cd/klm | 167 cd/klm | 168 cd/klm |

The light patterns of FIGS. 6D, 6E and 6F are generated by the wide-angle linear LED lighting device of FIG. 5. For producing the light pattern of FIG. 6D, the polygonal lampshade 40 has a hollow triangular cross section, the included angle θ is 60 degree, and the height of the raised part is 0 mm. For producing the light pattern of FIG. 6E, the polygonal lampshade 40 has a hollow triangular cross section, the included angle θ is 60 degree, and the height of the raised part is 6 mm. For producing the light pattern of FIG. 6F, the polygonal lampshade 40 has a hollow triangular cross section, the included angle θ is 60 degree, and the height of the raised part is 13 mm. As the height of the raised part is increased, the beam angle is decreased and the backside energy (%) is decreased, but the directly-below light intensity is increased.

According to the simulated results of FIGS. 6A to 6F and Table 1, the front side light intensity and the backside light intensity of the light pattern produced by the wide-angle linear LED lighting device of the present invention are adjustable according to the practical requirements.

From the above descriptions, the present invention provides the wide-angle linear LED lighting device. The wide-angle linear LED lighting device comprises the polygonal lampshade, the at least two LED modules and the base. The profile of the polygonal lampshade, the included angle between the base and the installation part of the polygonal lampshade and the height of the raised part are designed and matched, the beam angle is widened and the light beams are scattered at a wide angle. Moreover, the light beams are scattered more uniformly, the backside energy is increased, the spatial background brightness is increased, and the anti-glare function is achieved. Since the wide-angle linear LED lighting device of the present invention has a simple structure and is easily installed, the fabricating cost is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wide-angle linear LED lighting device, comprising:

a polygonal lampshade comprising at least two lateral parts and an installation part;

a base disposed within the polygonal lampshade and disposed on an inner surface of the installation part, wherein there is an included angle between the base and the inner surface of the installation part; and at least two LED modules disposed on the base, wherein light beams emitted by the at least two LED modules are outputted from different lateral parts, wherein the polygonal lampshade has a linear hollow tube profile with a hollow trapezoid cross section, and a front part of the polygonal lampshade is longer than the installation part, by adjusting the included angle and the position of the at least two LED modules incorporating with the inverted trapezoid profile of the polygonal lampshade, light-outputting characteristics are adjusted and the backside energy and the spatial background brightness are increased.

2. The wide-angle linear LED lighting device according to claim 1, wherein an outer surface of the installation part faces a mounting surface.

3. The wide-angle linear LED lighting device according to claim 1, wherein a distance between each of the LED modules and the inner surface of the installation part is in a range between 0 and 30 mm.

4. The wide-angle linear LED lighting device according to claim 1, wherein the base comprises at least two slabs, and the at least two LED modules are disposed on the corresponding slabs.

5. The wide-angle linear LED lighting device according to claim 4, wherein the at least two slabs of the base are integrally formed into one piece.

6. The wide-angle linear LED lighting device according to claim 4, wherein a distance between every two adjacent slabs of the base is in a range between 0 and 20 mm.

7. The wide-angle linear LED lighting device according to claim 4, wherein an included angle between each slab of the base and the inner surface of the installation part is in a range between 0 and 90 degrees.

8. The wide-angle linear LED lighting device according to claim 4, wherein an included angle between each slab of the base and the inner surface of the installation part is in a range between 60 and 90 degrees.

9. The wide-angle linear LED lighting device according to claim 4, wherein the at least two LED modules are fixed on the corresponding slabs of the base through an engaging means.

10. The wide-angle linear LED lighting device according to claim 4, wherein the at least two LED modules are fixed on the corresponding slabs of the base through an adhesive.

11. The wide-angle linear LED lighting device according to claim 4, wherein the base further comprises a raised part, and the at least two slabs are disposed on the raised part, so that a distance between the at least two LED modules and the inner surface of the installation part is increased.

12. The wide-angle linear LED lighting device according to claim 1, wherein the light-outputting characteristics of the wide-angle linear LED lighting device are further correlated with the profile of the polygonal lampshade and a distance between the at least two LED modules and the installation part.

13. The wide-angle linear LED lighting device according to claim 1, wherein the polygonal lampshade is made of a translucent material.

* * * * *